US005592210A

United States Patent [19]

Hara et al.

[11] Patent Number: 5,592,210

[45] Date of Patent: Jan. 7, 1997

[54] METHOD AND APPARATUS FOR DRIVING EDGE EMISSION TYPE LINE HEAD

[75] Inventors: Kei Hara; Shigeru Morino, both of Shizuoka, Japan

[73] Assignee: Kabushiki Kaisha TEC, Shizuoka, Japan

[21] Appl. No.: 141,637

[22] Filed: Oct. 27, 1993

[30] Foreign Application Priority Data

Oct. 27, 1992 [JP] Japan ..... 4-288410

[51] Int. Cl.[6] ..... B41J 2/447; B41J 2/47

[52] U.S. Cl. ..... 347/237; 347/130

[58] Field of Search ..... 347/237, 240, 347/130, 118, 131, 132; 345/92, 97; 355/69, 200; 359/93, 56

[56] References Cited

U.S. PATENT DOCUMENTS

| | | | |
|---|---|---|---|
| 4,386,352 | 5/1983 | Nonomura et al. | 345/92 |
| 5,128,696 | 7/1992 | Watanabe | 347/130 |
| 5,138,338 | 8/1992 | Mochizuki et al. | 347/237 |
| 5,182,595 | 1/1993 | Fukuchi et al. | 355/200 |

FOREIGN PATENT DOCUMENTS

| | | |
|---|---|---|
| 2-274569 | 11/1990 | Japan . |
| 3-256074 | 11/1991 | Japan . |

*Primary Examiner*—Benjamin R. Fuller
*Assistant Examiner*—Thinh Nguyen
*Attorney, Agent, or Firm*—Oblon, Spivak, McClelland, Maier, & Neustadt, P.C.

[57] ABSTRACT

A method and an apparatus for driving an edge emission type line head having a plurality of edge emission type EL elements grouped in blocks. Each group of the edge emission type EL elements has a channel electrode connected to a channel driver and has a common electrode connected via a matrix circuit to common terminals of a common driver. The channel driver outputs voltages while the common driver outputs alternately a positive and a negative high voltage. If something happens to stop the function of the line head in operation, the output of the common driver is stopped after a pair of a positive and a negative high voltage is output by one common terminal, or after one-line output is effected by the common driver. This helps prolong the service life of the edge emission type EL elements constituting the line head.

12 Claims, 13 Drawing Sheets

START

TURN ON POWER SWITCH
TURN ON +24V (HIGH VOLTAGE SUPPLY INPUT) TO START HIGH VOLTAGE SUPPLY OUTPUT
START PRINTING
OUTPUT POSITIVE COMMON (1)
CAUSE OF FUNCTION STOP DETECTED?
YES
NO
OUTPUT NEGATIVE COMMON (1)
OUTPUT NEGATIVE COMMON (1)
YES
CAUSE OF FUNCTION STOP DETECTED?
NO
OUTPUT POSITIVE COMMON (2)
CAUSE OF FUNCTION STOP DETECTED?
YES
NO

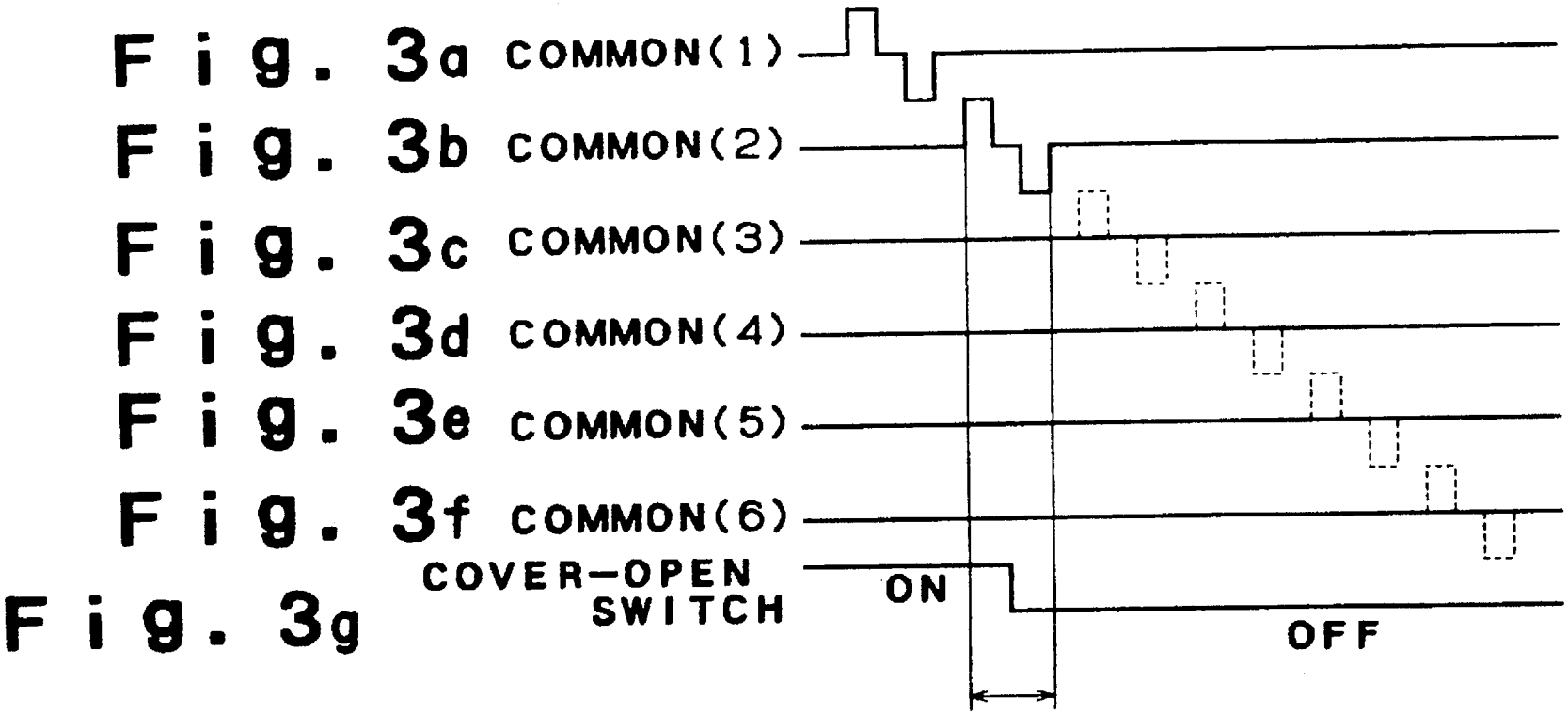
Fig. 3a COMMON(1)
Fig. 3b COMMON(2)
Fig. 3c COMMON(3)
Fig. 3d COMMON(4)
Fig. 3e COMMON(5)
Fig. 3f COMMON(6)
Fig. 3g COVER-OPEN SWITCH
ON
OFF

START

TURN ON POWER SWITCH
TURN ON +24V (HIGH VOLTAGE SUPPLY INPUT) TO START HIGH VOLTAGE SUPPLY OUTPUT
START PRINTING
OUTPUT POSITIVE COMMON (1)
CAUSE OF FUNCTION STOP DETECTED?
YES
NO
OUTPUT NEGATIVE COMMON (2)
OUTPUT NEGATIVE COMMON (2)
CAUSE OF FUNCTION STOP DETECTED?
YES
NO
OUTPUT POSITIVE COMMON (m)
OUTPUT POSITIVE COMMON (m)
CAUSE OF FUNCTION STOP DETECTED?
YES

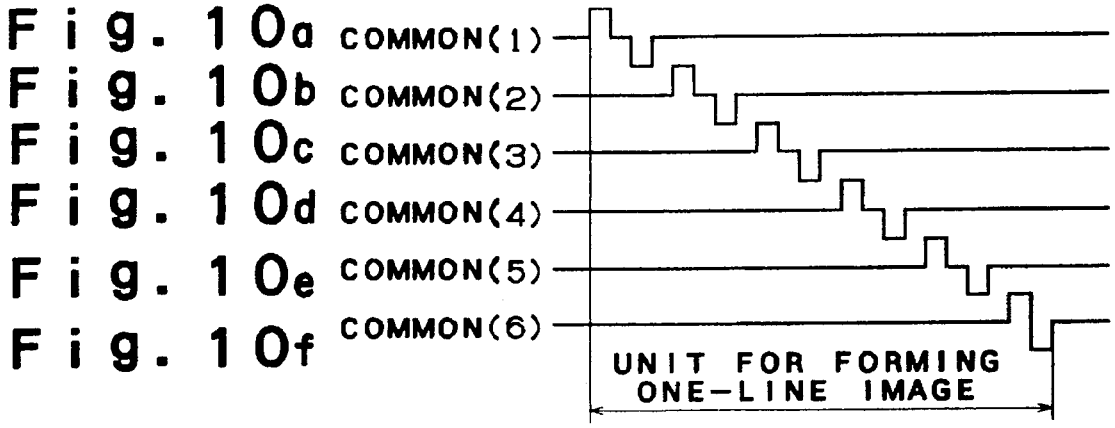
Fig. 10a
Fig. 10b
Fig. 10c
Fig. 10d
Fig. 10e
Fig. 10f
COMMON(1)
COMMON(2)
COMMON(3)
COMMON(4)
COMMON(5)
COMMON(6)
UNIT FOR FORMING ONE-LINE IMAGE
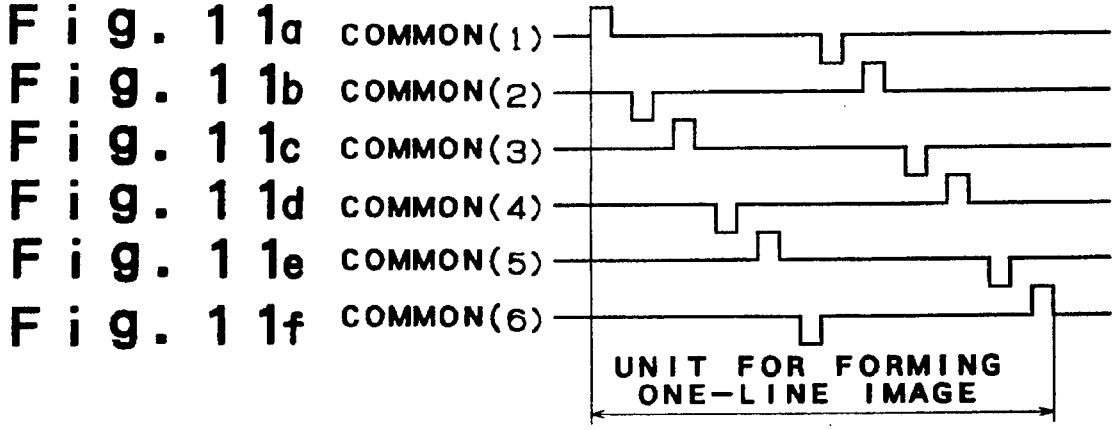
Fig. 11a
Fig. 11b
Fig. 11c
Fig. 11d
Fig. 11e
Fig. 11f
COMMON(1)
COMMON(2)
COMMON(3)
COMMON(4)
COMMON(5)
COMMON(6)
UNIT FOR FORMING ONE-LINE IMAGE COMMON (1)
COMMON (2)
COMMON (3)
COMMON (4)
COMMON (5)
COMMON (6)
COVER-OPEN SWITCH
ON
OFF

METHOD AND APPARATUS FOR DRIVING EDGE EMISSION TYPE LINE HEAD

BACKGROUND OF THE INVENTION

1. Field of the Invention

The present invention relates to a method and an apparatus for driving an edge emission type line head. More particularly, the invention relates to a method and an apparatus for driving an edge emission type line head comprising edge emission type EL (electroluminescent) elements to which positive and negative high voltages are applied alternately.

2. Description of the Related Art

The line printer is one of recently developed printers that operate on the principle of electrophotography. The line printer comprises a photosensitive drum whose periphery is surrounded by a charging device, a line head, a developing device and a transfer device. The peripheral surface of the photosensitive drum is charged at a predetermined potential level by the charging device. When a printing data is supplied to the printer, an optical signal corresponding to that printing data is emitted by light-emitting devices of the line head to form an electrostatic latent image on the charged peripheral surface of the photosensitive drum. The electrostatic latent image on the photosensitive drum is developed by the developing device using toner. The toner-developed image is transferred by transfer device onto an image forming medium such as a sheet of paper. With this type of line printer, edge emission type EL elements may be utilized as a line head.

As shown in FIG. 6, an edge emission type EL element 6 comprises dielectric layers 2 and 3 that sandwich a thin film active layer 1 comprising active elements including zinc sulfide, the surfaces of the layers 2 and 3 having flat electrodes 4 and 5 deposited thereon. In operation, a voltage is applied to the flat electrodes 4 and 5. This causes an edge of the active layer 1 to emit a light beam. A number of such edge emission type EL elements 6 are arranged linearly by thin film technique or the like on a substrate 7, as depicted in FIG. 7. A rod lens array, not shown, is positioned opposite to the tips of the edge emission type EL elements to form a line head 8.

FIG. 8 is a circuit diagram of a typical prior art circuit for driving the line head 8. The edge emission type EL elements 6 of the line head 8 are grouped into blocks composed of n (e.g., 6) continuous devices each. Each block has its channel electrode connected to a channel driver 9. There is provided a common driver 10 comprising m (e.g., 6) common terminals $\mathbf{10}_1$ through $\mathbf{10}_6$. Each of the common terminals $\mathbf{10}_1$ through $\mathbf{10}_6$ is connected to a connection line 11. The common electrode of the edge emission type EL elements within each block is connected to a different connection line 11, whereby a matrix circuit 12 is formed. The channel drivers 9 are connected to a channel driver control unit 13 and a data control unit 14. The common driver 10 is connected to a common driver control unit 15.

The operation of the line head 8 will now be described with reference to the timing chart of FIGS. 9–*c*. The channel electrode of the edge emission type EL elements 6 is fed with channel electrode voltages Va and Vb from the channel drivers 9. The common electrode of the edge emission type EL elements 6 is supplied with common electrode voltages $V_P$ and $V_N$ from the common terminals $\mathbf{10}_1$ through $\mathbf{10}_6$ of the common driver 10. "$V_P$" stands for a positive high voltage and "$V_N$" for a negative high voltage. When the difference between the voltages Va and Vb from the channel driver 9 on the one hand, and the corresponding high voltages $V_P$ and $V_N$ from the common driver 10 on the other is greater than a threshold voltage $V_{th}$, the edge emission type EL element 6 emits light. According to electrophotography, the emitted light reaches a photosensitive body to form an electrostatic latent image thereon. The electrostatic latent image is then developed and transferred onto an appropriate sheet of paper.

If it is desired to perform printing on a letter size sheet of a density of 300 dpi (dot per inch), it is necessary to arrange about 2,500 edge emission type EL elements 6 in a row. To drive such numerous EL elements 6 would require very complicated driving circuitry. This difficulty is overcome using the matrix circuit 12 mentioned above. In operation, the common electrode voltages $V_P$ and $V_N$, are output successively from the common terminals 10. In synchronism with the voltages $V_P$ and $V_N$, the channel electrode voltages Va and Vb are fed from the channel electrodes. For example, it may be desired first to activate the edge emission type EL element 6 connected to the common terminal $\mathbf{10}_1$ and to the channel electrode of the n-th block. In such a case, the channel electrode voltages Va and Vb needed to activate the edge emission type EL element 6 are output from the channel electrode of the n-th block in synchronism with the common electrode voltages $V_P$ and $V_N$ being output from the common terminal $\mathbf{10}_1$. Next, it may be desired to activate the edge emission type EL element 6 connected to the common terminal $\mathbf{10}_2$ and to the channel electrode of the n-th block. This requires getting the channel electrode of the n-th block to output the channel electrode voltages Va and Vb needed to activate the EL element 6, the output being performed in synchronism with the common electrode voltages $V_P$ and $V_N$ output from the common terminal $\mathbf{10}_2$ following the voltage output from the common terminal $\mathbf{10}_1$. In like manner, the edge emission type EL elements 6 connected to the common terminals $\mathbf{10}_1$ through $\mathbf{10}_6$ have been activated. This completes the image forming operation for one line.

Aside from detailed analyses, experiments have revealed that applying only positive (or negative) high voltages to the common electrode of the edge emission type EL elements shortens the service life of the latter. This flaw is circumvented traditionally by having the common driver 10 output alternately the positive voltage $V_P$ and the negative voltage $V_N$. One way of implementing the alternate positive-negative voltage output scheme is to output successively pairs of positive and negative pulses to m (e.g., 6) common terminals, as illustrated in FIGS. 10*a–f*. FIGS. 11*a–f* shows another way of implementing the same scheme, whereby the common terminals output positive and negative pulses in a successively alternate manner and then reverse the polarities of the respective pulses to output them likewise. In FIGS. 10*a–f* and 11*a–f*, the output from the first common terminal $\mathbf{10}_1$ is denoted as Common (1), the output from the second common terminal $\mathbf{10}_2$ as Common (2), the output from the third common terminal $\mathbf{10}_3$ as Common (3), and so on. The output patterns shown in FIGS. 10 and 11 are each the unit in which a one-line image is formed.

A major disadvantage of the above-described prior art is as follows: during image formation, something can happen to halt the image forming function halfway. For example, the printer cover may be opened inadvertently during image formation. The cover action illustratively operates a cover-open switch to bring the image forming function to a stop. The image forming function may also be halted in case of a jammed sheet. The moment a sheet is found to be jammed, the image forming operation is stopped, and the output from the common driver 10 also ends simultaneously. Suppose that while the line head 8 is being driven under the driving scheme of FIG. 10, something happens to stop the image forming function (cover-open switch operated, jammed sheet detected, etc.). At that point, the output from the common driver 10 is also stopped. FIGS. 12*a–c* shows a state in which something happened to stop the image forming function after the second common terminal $\mathbf{10}_2$ output a positive high voltage; FIGS. 12*f–g* ) shows a state in which something happened to stop the image forming function while a positive high voltage is being output from the second common terminal $\mathbf{10}_2$. In either case, no further output comes out of the common driver 10.

When the line head 8 is driven under the driving scheme of FIGS. 11*a–f*, the output of the common driver 10 is stopped the moment something happens to halt the image forming function. FIGS. 13*a–g* shows a state in which something happened to stop the image forming function after the third common terminal $\mathbf{10}_3$ outputs a negative high voltage. In this case, no further output is made by the common driver 10 while the output of one-line pulses is suspended.

In other words, the states shown in FIGS. 12*a–j* prevent one edge emission type EL element 6 from getting fed with a pair of a positive and a negative high voltage. This, as described above, leads to shortening the service life of the edge emission type EL element 6. The same holds true for the state of FIGS. 13*a–g*. When the emission frequency varies from one edge emission type EL element 6 to another in a single line, the individual devices 6 can incur differences in the duration of their service life. As a result, the service life of the line head 8 can be shortened inordinately.

SUMMARY OF THE INVENTION

It is therefore an object of the present invention to provide a method and an apparatus for driving an edge emission type line head comprising edge emission type EL elements whose service life is protected from getting shortened even if any cause to stop the image forming function occurs during image formation.

According to the invention, there is provided a method or an apparatus for driving an edge emission type line head having a plurality of edge emission type EL elements grouped in blocks. Each group of the edge emission type EL elements has a channel electrode connected to a channel driver and has a common electrode connected via a matrix circuit to common terminals of a common driver. The channel driver outputs voltages while the common driver outputs alternately a positive and a negative high voltage. A pair of a positive and a negative high voltage pulse is set to be the unit of voltage output from any one of the common terminals. If something happens to stop the function of the edge emission type line head while the line head is being driven, the output of the common driver is stopped after one of the common terminals has output one pair of the positive and negative high voltage pulses. Alternatively, the unit of voltage output from the common driver is set to be a one-line voltage output. In this case, if something happens to stop the function of the edge emission type line head while the line head is being driven, the output of the common driver is stopped after it has effected a one-line output. This scheme helps to prolong the service life of the edge emission type EL elements constituting the line head.

These and other objects, features and advantages of the invention will become more apparent upon a reading of the following description and appended drawings.

BRIEF DESCRIPTION OF THE DRAWINGS

FIGS. 3*a–g* is a timing chart of assistance in explaining how the common driver in the first embodiment effects its output when something happens to stop the function of the line head;

FIGS. 10*a–f* is a timing chart of assistance in explaining a typical pattern of a one-line output effected by a common driver;

FIGS. 11*a–f* is a timing chart of assistance in explaining another typical pattern of a one-line output effected by a common driver;

DETAILED DESCRIPTION OF PREFERRED EMBODIMENTS

Figure 1:
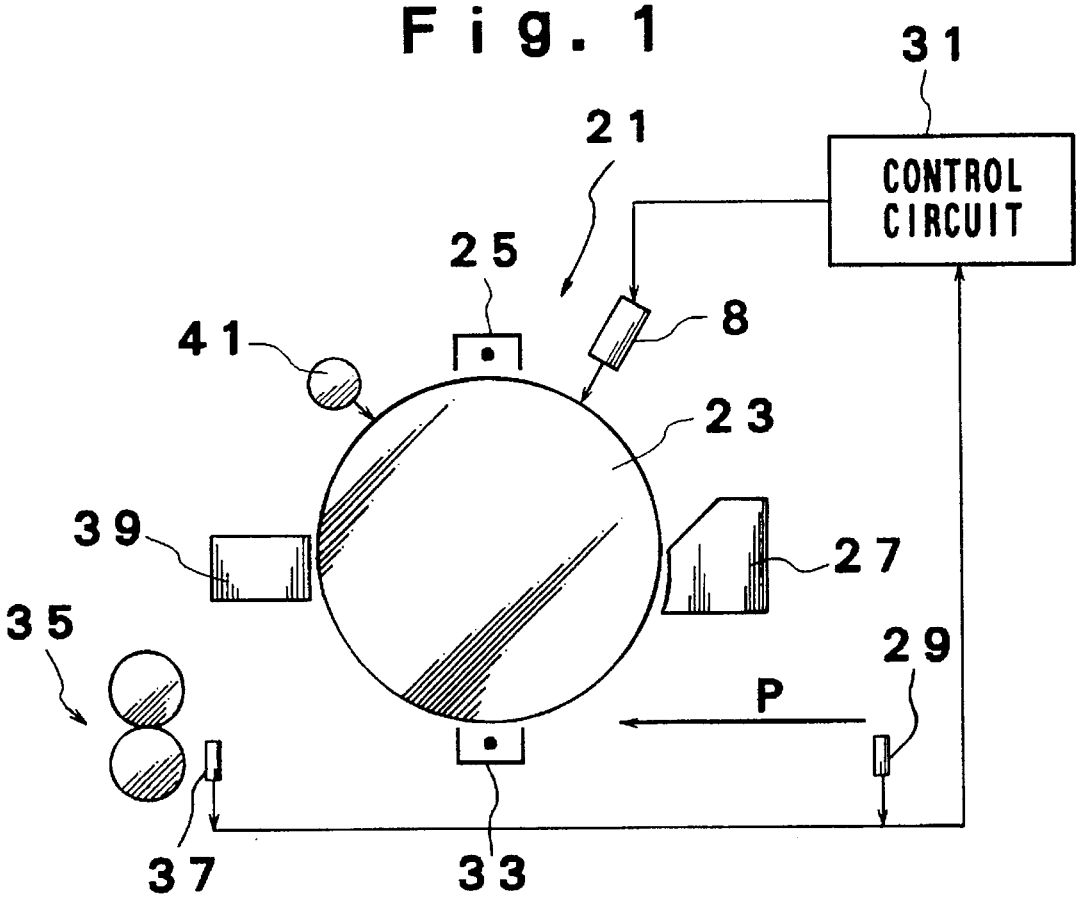
FIG. 1 is a side view of an image forming portion in a printer in a first embodiment according to the invention.

The first embodiment of the present invention will now be described with reference to FIGS. 1 through 3 and FIGS. 6 through 10. Those parts in FIGS. 6 through 8 which were already discussed in connection with the prior art are referred to using the same reference numerals, and any repetitive description of these parts is omitted.

A printer 21 practiced as the first embodiment of the invention will now be outlined by referring to FIG. 1. The printer 21 comprises a photosensitive drum 23 acting as an image bearing body. Around the photosensitive drum 23 are a charging device 25 and a developing device 27 that contains toner. The charging device 25 is a corotron type that charges the surface of the photosensitive drum 23 uniformly. The surface of the photosensitive drum 23 interposed between the charging device 25 and the developing device 27 is a light exposure area. A line head 8 including numerous edge emission type EL elements is positioned opposite to the light exposure area. Given a signal corresponding to the image to be printed, the line head 8 emits light accordingly. The light emission directed at the light exposure area of the photosensitive drum 23 forms an electrostatic latent image in that area. The latent image is developed by the developing device 27.

A sheet of paper P used as an image forming medium is picked up from a sheet cassette, not shown, at an appropriate timing. The paper P is then transported along a paper transport route, not shown, to the photosensitive drum 23. During the transporting process, the edge of the paper P is detected by a first paper sensor 29. A sense signal from the sensor 29 is input to a control circuit 31 of known construction. The control circuit 31 stores a predetermined period of time that should elapse from the time the paper P is picked up until the tip of the paper P is detected by the first paper sensor 29. If the first paper sensor 29 fails to output the sense signal within the predetermined time after the paper P is picked up, the control circuit 31 judges that the paper P is jammed. In that case, the control circuit 31 prevents the line head 8 from emitting light. If the light emitting operation has been in progress, the operation is stopped immediately, and the occurrence of paper jamming is indicated on a display unit, not shown.

When the paper P is picked up and the sense signal from the first paper sensor 29 is input to the control circuit 31 within the predetermined period of time, the control circuit 31 judges that the paper P has been transported normally and allows light exposure and developing operations (constituting an image forming process) to take place. The image thus developed on the photosensitive drum 23 is transferred to the paper P by a scorotron transfer-charging device 33. After the transfer, the paper P is fed forward along a paper transport route, not shown, toward a fixing machine 35. Along the way, a second paper sensor 37 senses the edge of the paper P. Upon sensing the presence of the paper P, the second paper sensor 37 outputs a sense signal to the control circuit 31. The control circuit 31 stores a predetermined period of time that should elapse from the time the paper P is sensed by the first paper sensor 29 until the paper P is sensed by the second paper sensor 37. When the control circuit 31 receives the sense signal from the second paper sensor 37 within the predetermined period of time, the control circuit 31 judges that the paper P is transported normally and allows subsequent operations to take place. If the control circuit 31 fails to receive the sense signal from the second paper sensor 37 within the predetermined period of time, the control circuit 31 judges that the paper P is jammed and stops immediately the light emitted from the line head 8.

As with conventional printers, the end of the transfer process is followed by the cleaning of residual toner by a cleaner 39 off the surface of the photosensitive drum 23 and by the discharging of the surface of the photosensitive drum 23 by a discharging lamp 41. Thereafter, the same processes as described above are repeated. When the printer 21 functions normally, the paper P with its toner fixed by the fixing machine 35 is ejected to the outside.

Figure 8:
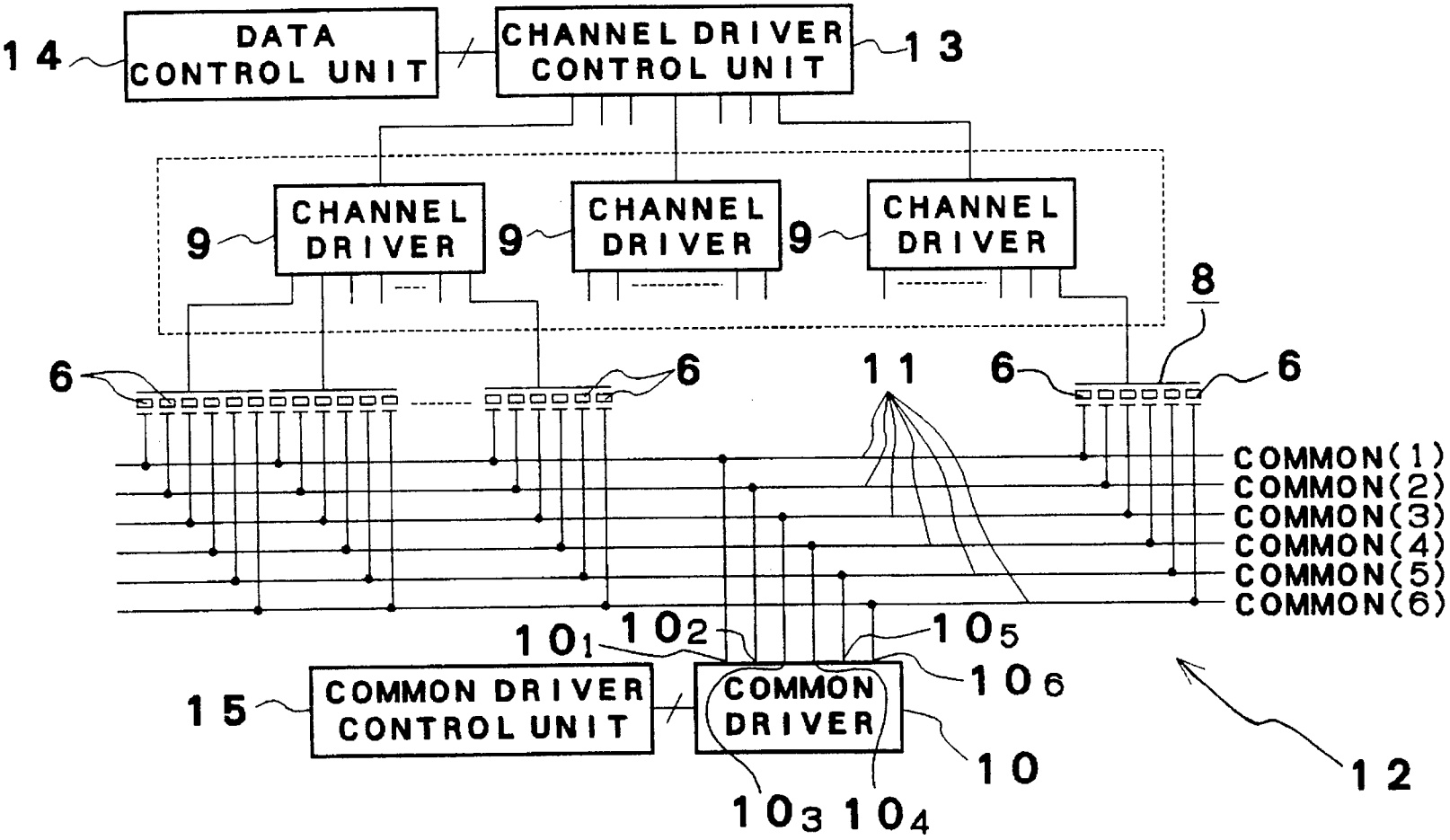
FIG. 8 is an electronic circuit diagram of a typical circuit for driving the line head.
Figures 9A, 9B, 9C:
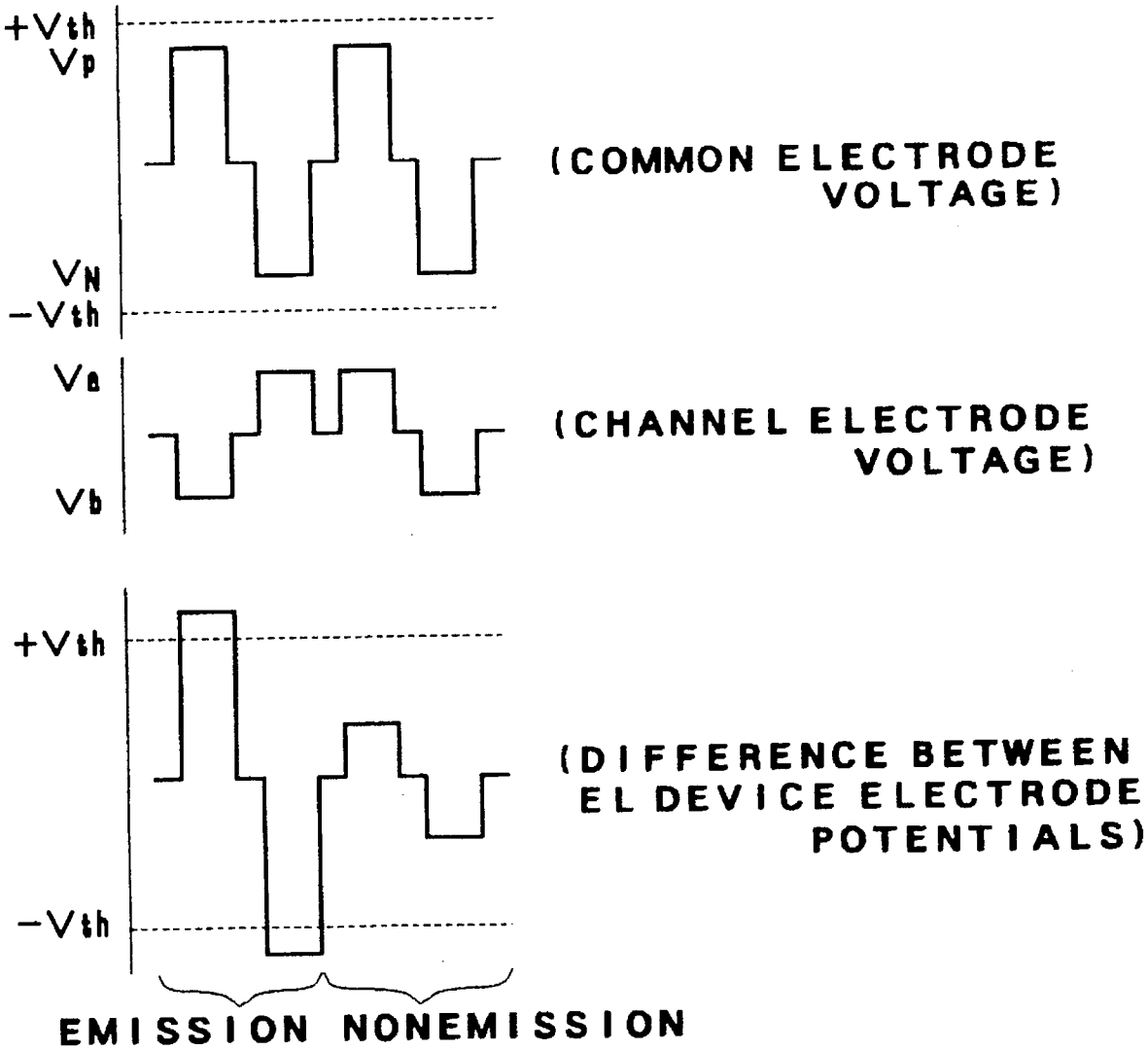
FIGS. 9*a–c* is a timing chart of assistance in explaining how an edge emission type EL element works conventionally.
Figures 12A, 12B, 12C, 12D, 12E, 12F, 12G, 12H, 12I, 12J:
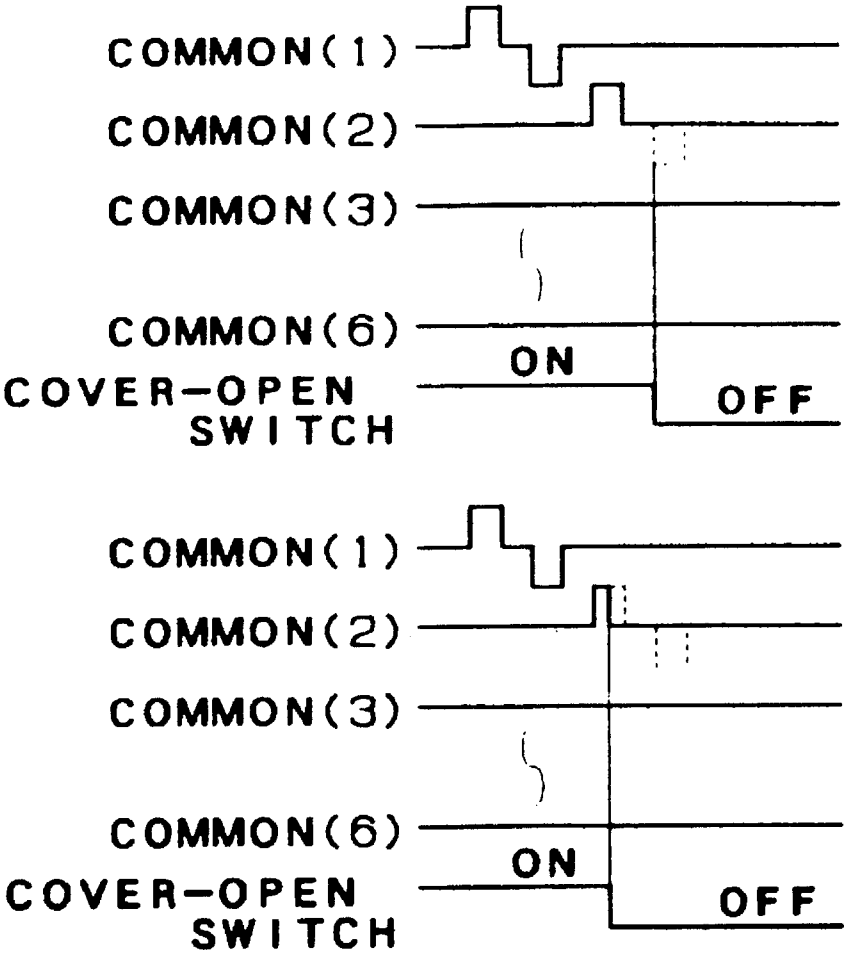
FIGS. 12*a–j* is a set of timing charts of assistance in explaining some conventional outputs effected by the common driver of the setup of FIG. 10 when something happens to stop the function of the line head.
Figures 13A, 13B, 13C, 13D, 13E, 13F, 13G:
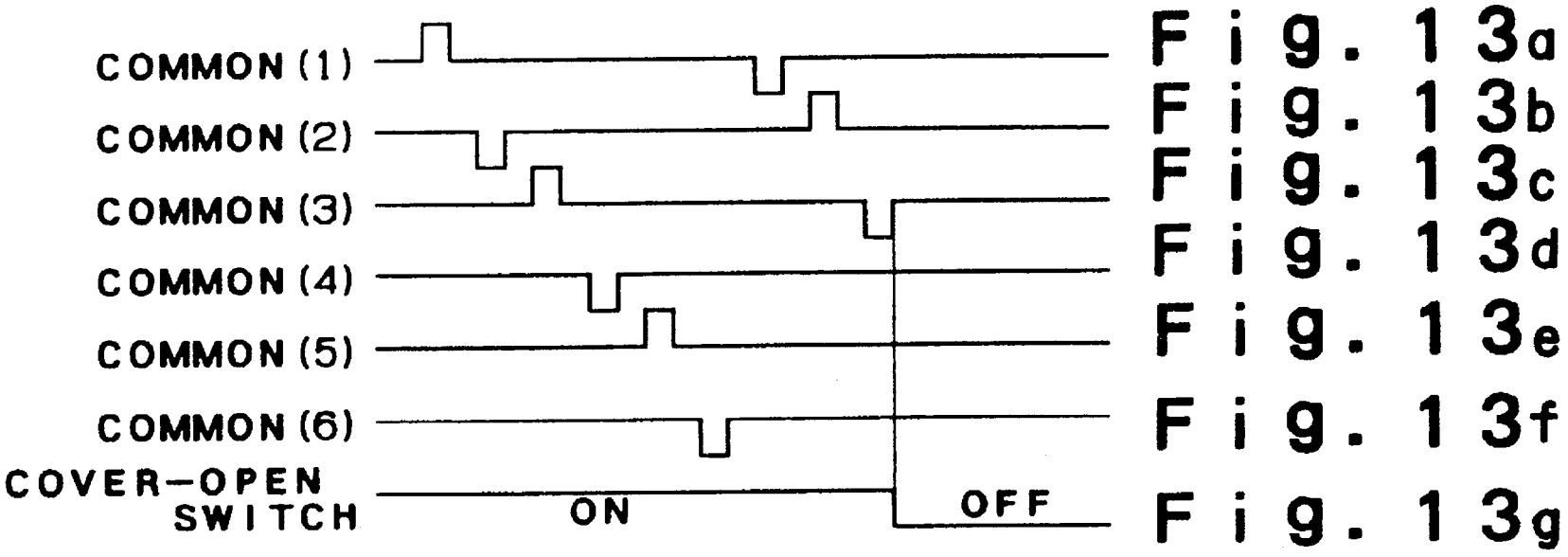
FIGS. 13*a–g* is a timing chart of assistance in explaining a conventional output effected by the common driver of the setup of FIG. 11 when something happens to stop the function of the line head.

When the line head 8 of the first embodiment is to emit light, the channel drivers 9 shown in FIG. 8 apply voltages to the channel electrodes of the edge emission type EL elements 6 and, at the same time, the common driver 10 outputs alternately positive and negative high voltages through the common electrodes to the edge emission type EL elements 6. This causes the edge emission type EL elements 6 to emit light. The operation of edge emission type EL element 6 was already described with reference to the timing chart of FIGS. 9*a–c*.

The common driver 10 causes pairs of a positive and a negative high voltage pulse to be output successively from the common terminals $\mathbf{10}_1$ through $\mathbf{10}_6$, thereby forming a one-line image. The output pattern in effect at this time was described earlier with reference to FIGS. 10*a–f*.

Figure 2A:
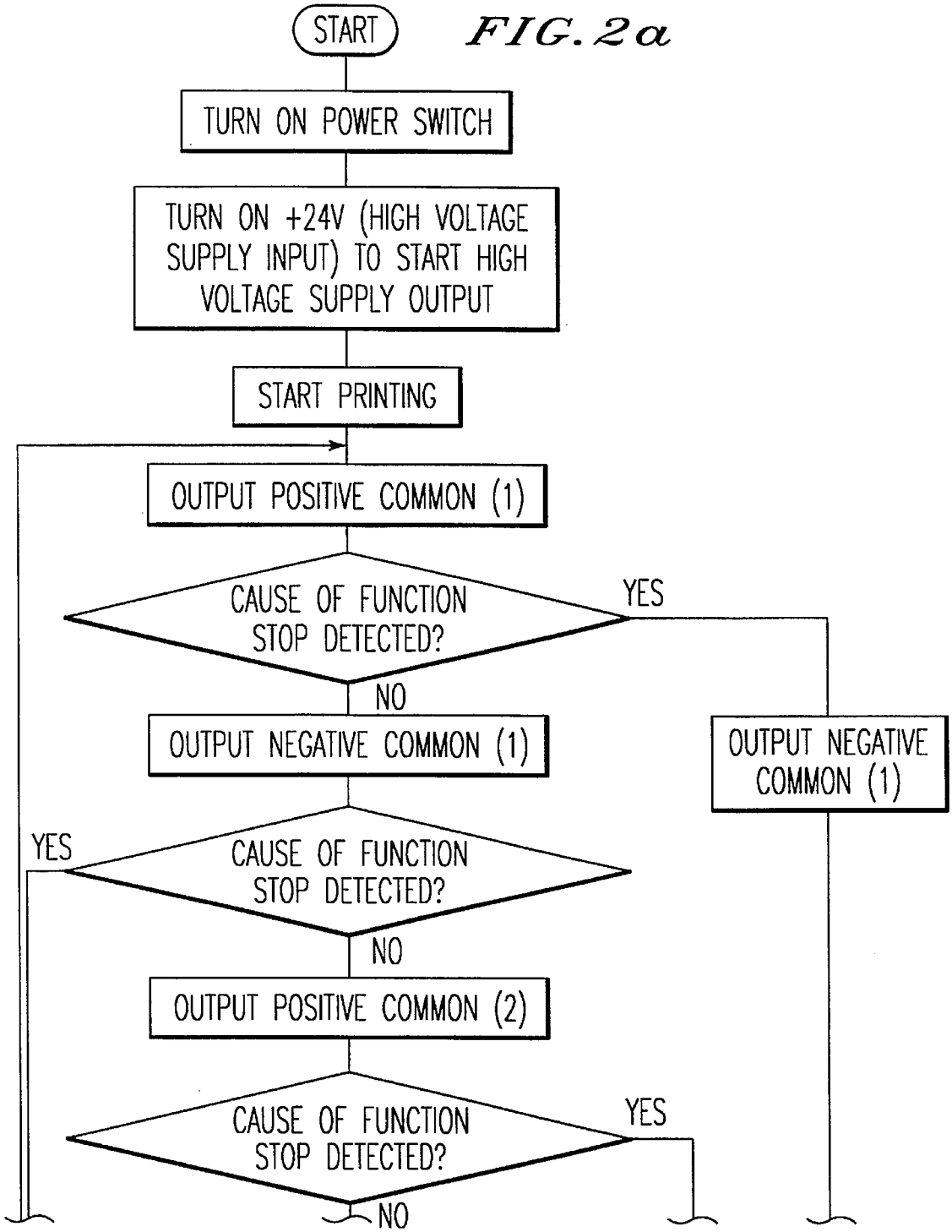
FIGS. 2*a–b* is a flowchart of assistance in explaining how to control the output of a common driver included in the first embodiment.
Figure 2B:
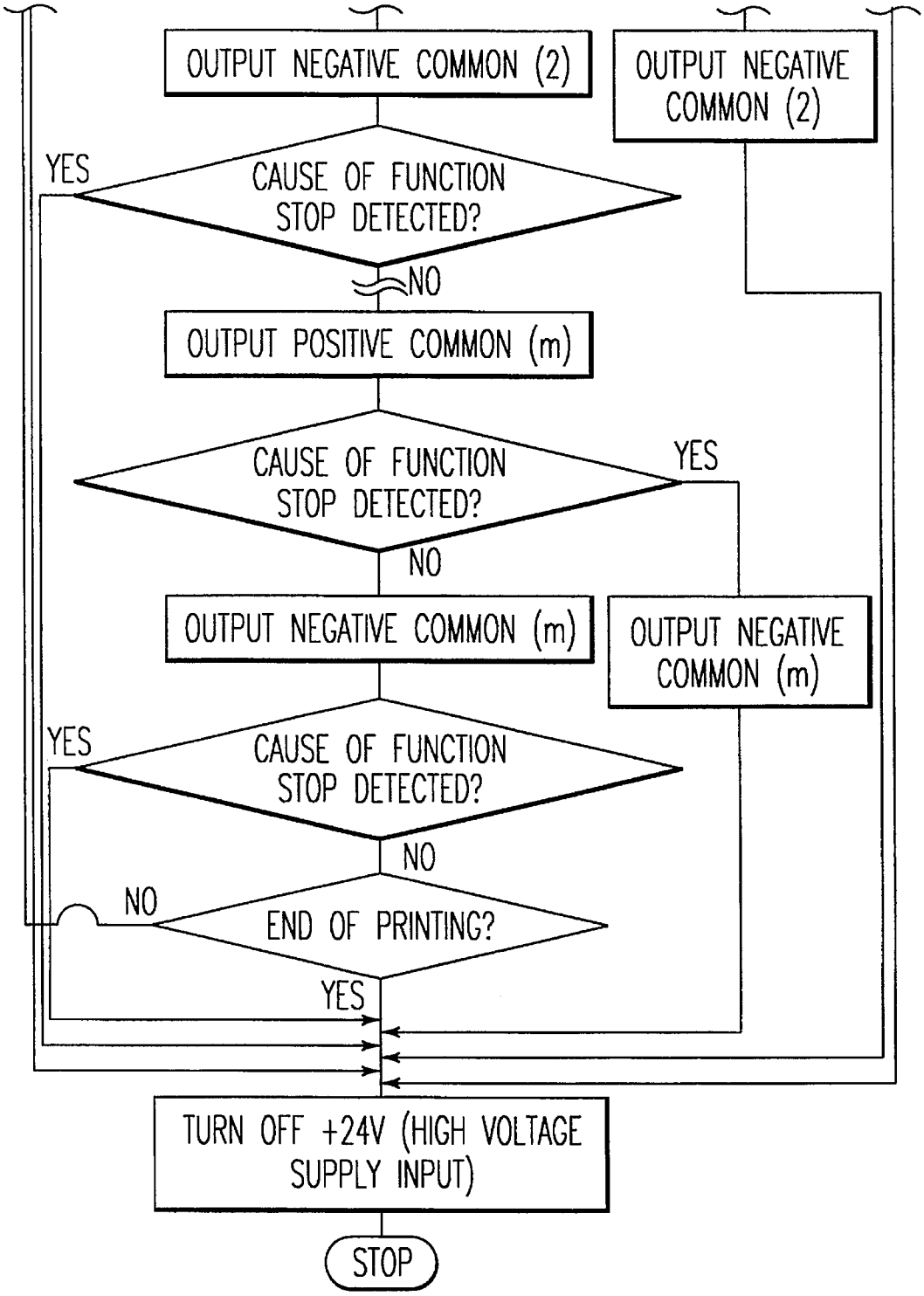

Suppose that while the common driver 10 is effecting its output in the above setup, something happens to stop the printer function (e.g., paper jammed, cover-open switch activated), as shown in the flowchart of FIGS. 2*a–b*. In that case, any one of the common drivers $\mathbf{10}_1$ through $\mathbf{10}_6$ currently performing its output is made to effect the unit output (i.e., one pair of a positive and a negative pulse) before the output of the common driver 10 is stopped. For example, as shown in FIGS. 3*a–g*, it may happen that something occurs to stop the printer function (paper jammed, cover-open switch operated, etc.) within a time t in which the output of Common (2) from the second common terminal $\mathbf{10}_2$ is effected following the output of Common (1) from the first common terminal $\mathbf{10}_1$. In this embodiment, the common driver 10 and the channel drivers 9 are stopped after the second common terminal $\mathbf{10}_2$ has completed its output of Common (2) composed of a pair of a positive and a negative pulse. The process is controlled by the common driver control unit 15 and by the channel driver control unit 13. In this manner, any one of the edge emission type EL elements 6 is always fed with a pair of a positive and a negative high voltage before the interruption of its operation. Because the first embodiment prevents any edge emission type EL element 6 from getting fed with only a positive or a negative high voltage before the interruption of voltage application, the service life of the EL element 6 is prolonged. Whether or not the paper is jammed is determined by the paper sensor 29 or 37 failing to sense the presence of the paper within the predetermined period of time. Whether or not the printer cover is opened is determined illustratively using the cover-open switch that is operated when the printer cover is opened.

A second embodiment of the invention will now be described with reference to FIGS. 4*a–b* through 9*a–c* and 11*a–f*. In describing the second embodiment, those parts that also appeared in the first embodiment are designated by like reference numerals and their descriptions are omitted. In the second embodiment, the common driver 10 first outputs one cycle of alternate positive and negative high voltages successively via the common terminals $\mathbf{10}_1$ through $\mathbf{10}_6$, and then outputs via the common terminals $\mathbf{10}_1$ through $\mathbf{10}_6$ another cycle of alternate negative and positive high voltages that are respectively opposite in polarity to those of the preceding cycle. The operation forms a one-line image. The output pattern of the one-line output was already discussed with reference to FIGS. 11*a–f*.

Figure 4A:
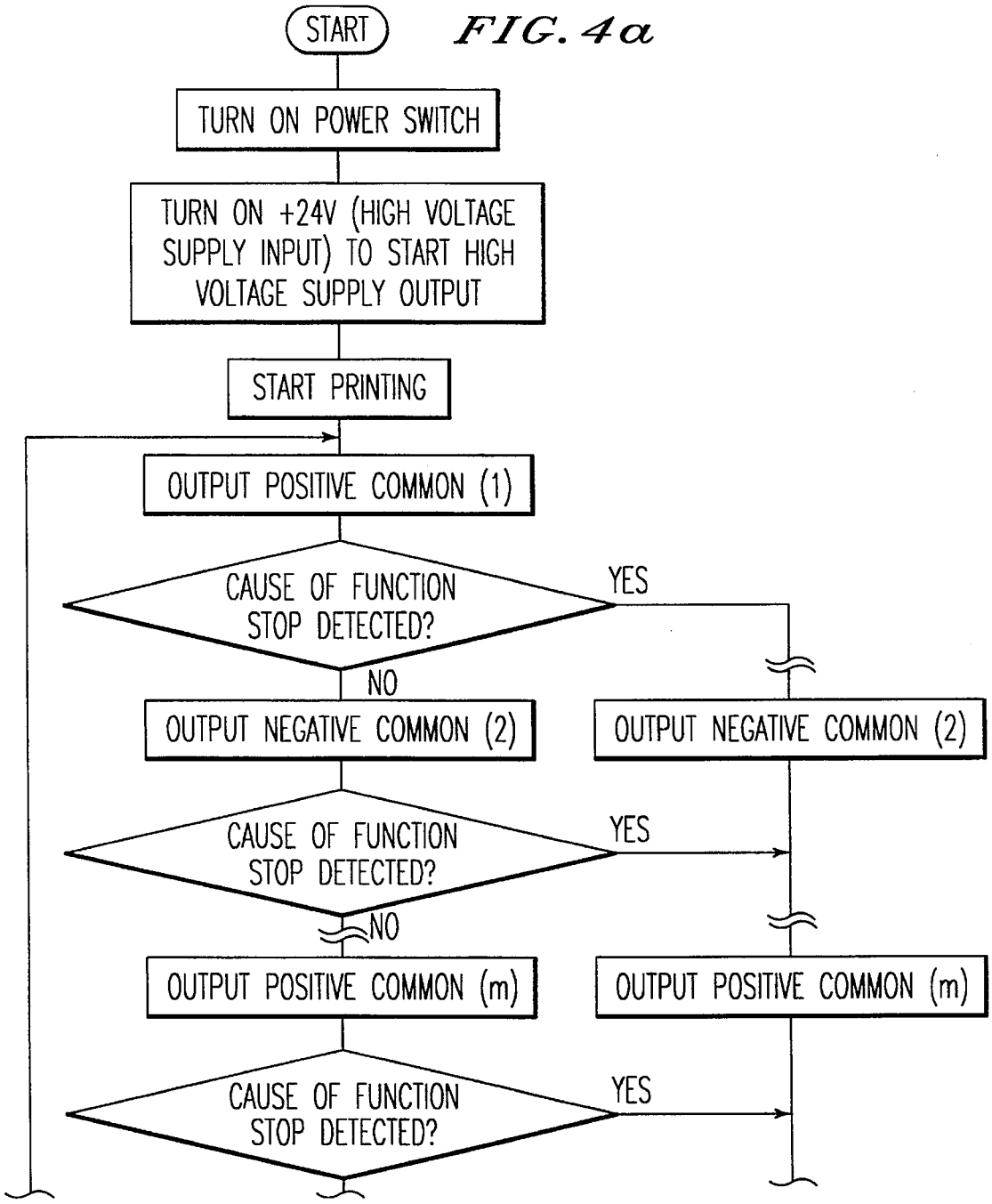
FIGS. 4*a–b* is a flowchart of assistance in explaining how to control the output of a common driver included in a second embodiment according to the invention.
Figure 4B:
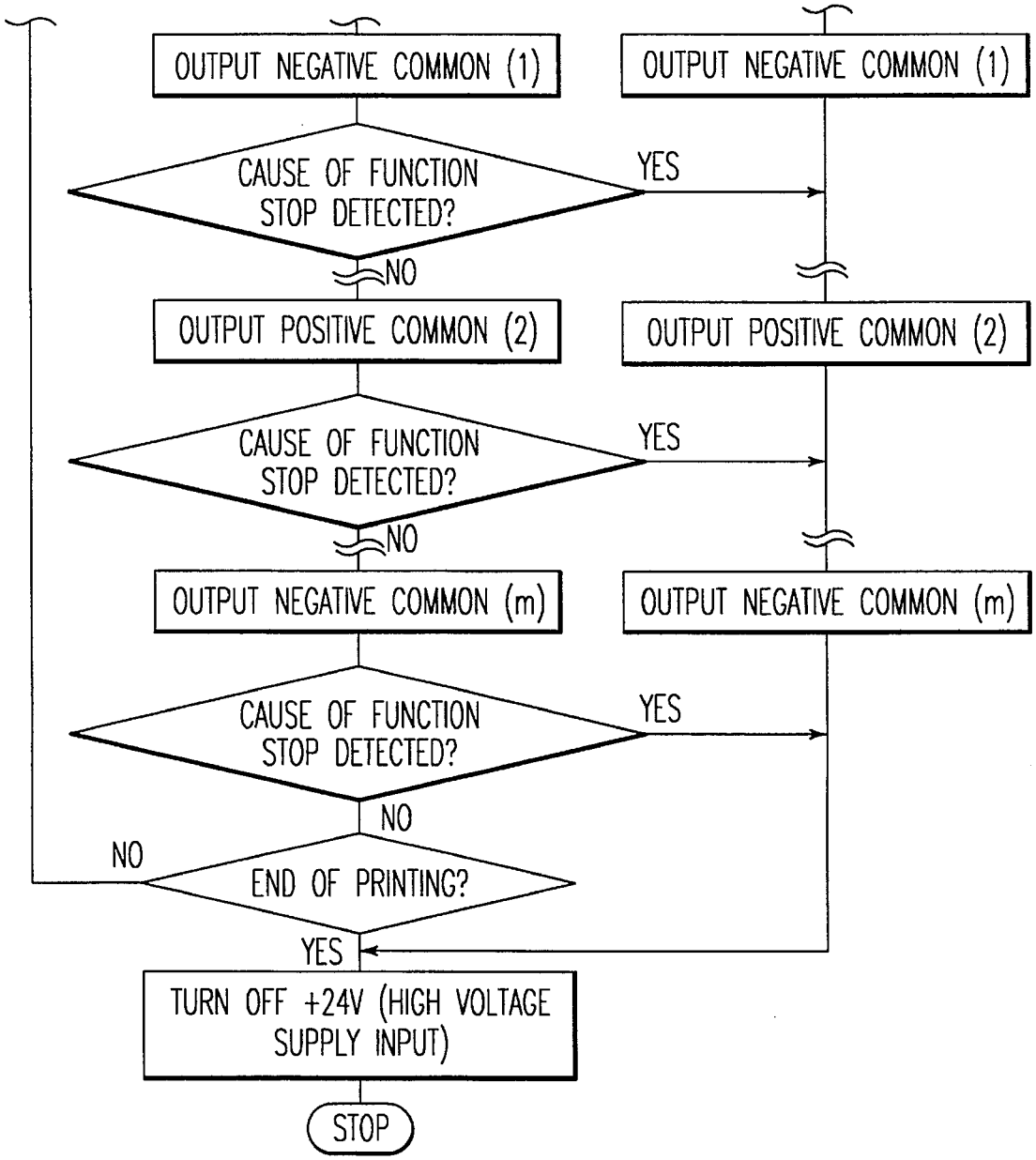
Figures 5A, 5B, 5C, 5D, 5E, 5F, 5G:
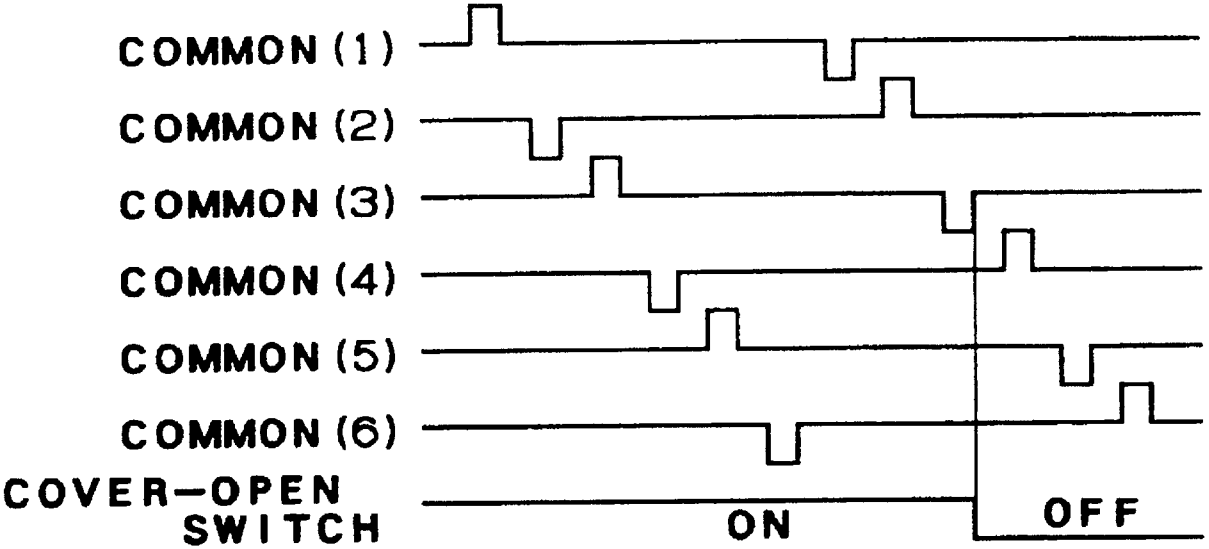
FIGS. 5*a–g* is a timing chart of assistance in explaining how the common driver in the second embodiment effects its output when something happens to stop the function of the line head.
Figure 6:
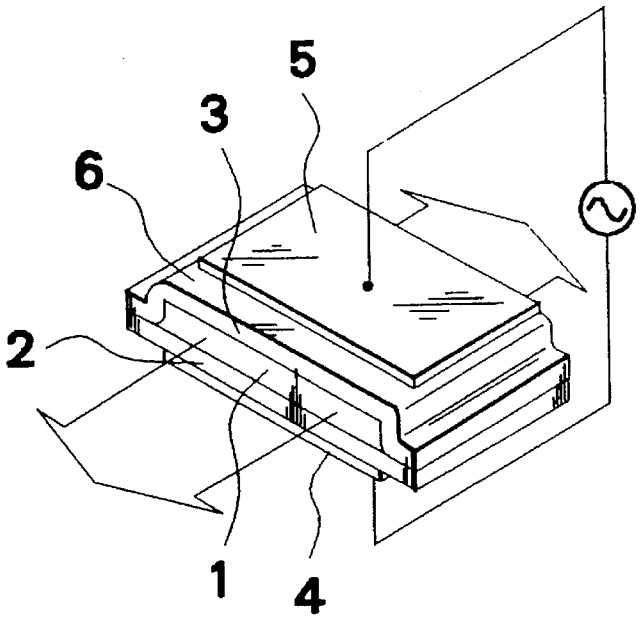
Fig. 6 (PRIOR ART)
FIG. 6 is a perspective view of a typical edge emission type EL element.
Figure 7:
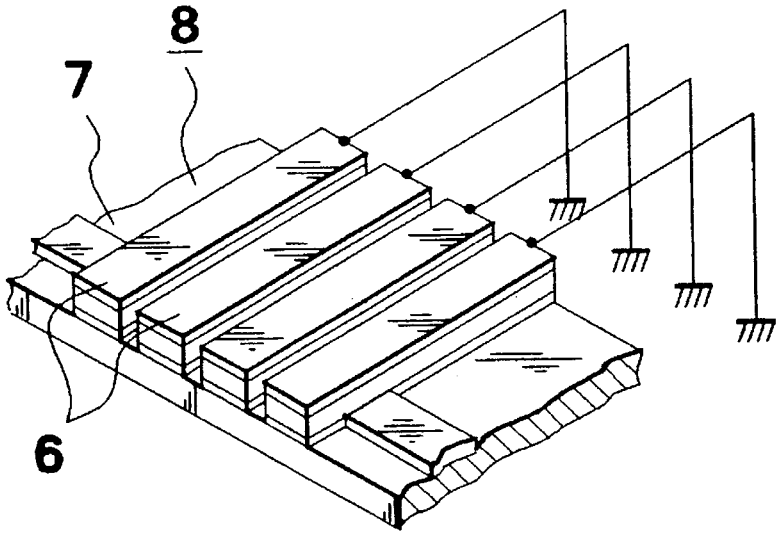
Fig. 7 (PRIOR ART)
FIG. 7 is a perspective view of a typical line head.

Suppose that while the common driver 10 is effecting its output to form a one-line image in the setup of the second embodiment, something happens to interrupt the printing operation (e.g., paper jammed, cover-open switch activated), as shown in the flowchart of FIGS. 4*a–b*. In that case, the output of the common driver 10 is stopped after it has completed its output for one-line image formation. The process is controlled by the common driver control unit 15. FIGS. 5*a–g* shows a typical pattern of the output effected by the common driver 10 to form a one-line image. The figure depicts that the output to form the entire line is completed even if the cover-open switch is activated while the one-line output is still in progress. This scheme prevents the emission frequencies of the edge emission type EL elements 6 for the whole line from becoming uneven. That in turn makes the individual edge emission type EL elements 6 approximately equal in service life, whereby the service life of the line head 8 is prolonged.

As many apparently different embodiments of this invention may be made without departing from the spirit and scope thereof, it is to be understood that the invention is not limited to the specific embodiments thereof except as defined in the appended claims.

What is claimed is:

1. An apparatus for driving an edge emission type line head having a plurality of edge emission electroluminescent EL elements grouped in blocks, each group of said edge emission type EL elements having a channel electrode connected to a channel driver and having a common electrode connected through a matrix circuit to common terminals of a common driver, said channel driver outputting voltages while said common driver outputs alternately a positive and a negative high voltage during operation of said line head, said apparatus comprising:

common pulse setting means for setting a plurality of pairs of a positive and a negative high voltage pulse as a respective plurality of units of voltage output from any one of said common terminals; and common pulse stopping means responsive to an interruption of the operation of the edge emission line head while said edge emission line head is being driven for causing any one of said common terminals to output a single unit of voltage output and then stopping the output of said common driver, whereby after said line head interruption only one of said units of voltage output is supplied to said common driver.

2. An apparatus for driving an edge emission type line head according to claim 1, wherein said unit of voltage output from any one of said common terminals is a pair of continuous positive and negative high voltages.

3. An apparatus for driving an edge emission type line head according to claim 1, wherein said unit of voltage output from said common driver is a cycle of discontinuous pairs of positive and negative high voltages for a single line.

4. A method for driving an edge emission type line head comprising a plurality of linearly arrayed edge emission electroluminescent EL elements each having common and channel electrodes to emit light onto an image bearing body in accordance with a signal indicating an image to be printed, said method including the steps of:

performing a light emitting operation of any one of said EL elements by supplying said EL element with a plurality of pairs of a first and second voltage through said common electrodes, said first and second voltages being positive and negative voltages, respectively and each of said pairs forming a unit of voltage from any one of said common terminals;

detecting an occurrence requiring the light emitting operation of said EL elements to be interrupted;

supplying, if said occurrence is detected while any one of said EL elements is being fed with one of said first and second voltages of one said unit voltage, said one EL element with said one unit of voltage so that first and second voltages of said one unit of voltage are applied to said one EL element; and stopping the supply of said first and second voltages to said EL elements through said common electrodes whereby after detecting said occurrence only one of said units of voltage is supplied to said EL element.

5. A method according to claim 4, wherein said image bearing body is developed in a developing operation after the light emitting operation is executed thereon whereby an image is developed on said image bearing body and transferred therefrom to an image forming medium which is subject to jamming, and wherein said detecting step further includes the step of detecting the jamming of said image forming medium.

6. A method according to claim 4, wherein said EL elements are divided into a plurality of blocks each comprising at least 2 of said EL elements, said channel electrodes of said EL elements being connected commonly within each of said blocks, and wherein said performing step includes the step of driving selectively said EL elements through said channel electrodes and said common electrodes as a function of said signal indicating an image to be printed.

7. A method according to claim 6, wherein said common electrode of each EL element in one block is connected commonly to said common electrodes of respective ones of said EL elements in other blocks in a matrix circuitry, and said performing step includes the step of supplying the same common electrode with said first and second voltages continuously.

8. A method according to claim 6, wherein said common electrode of each EL element in one block is connected commonly to the common electrode of said respective EL elements in other blocks in a matrix circuitry, said performing step includes the step of sequentially supplying said first and second voltages to different common electrodes.

9. A method according to claim 6, wherein said stopping step includes the step of stopping the driving of said EL elements through said channel electrodes.

10. A line head apparatus which carries out a light emitting operation onto an image bearing body in accordance with a signal indicating an image to be printed, said apparatus comprising:

a plurality of linearly arrayed edge emission electroluminescent EL elements;

a plurality of common electrodes fixed on said EL elements, said plurality of channel electrodes dividing said EL elements into a plurality of blocks each having at least two EL elements;

a plurality of common electrodes fixed on said plurality of EL elements, said common electrode of each EL element in one block being connected commonly to said common electrodes of respective one of said EL elements in other blocks in a matrix circuitry;

detecting means for detecting an occurrence requiring said light emitting operation of said EL elements to be interrupted; and executing means for executing said light emitting operation by controlling said EL elements through said channel electrodes and said common electrodes, said executing means including, means for carrying out said light emitting operation by supplying said EL elements with a plurality of pairs of a first and a second voltage through said common electrodes, said first and second voltages being positive and negative voltages, respectively and each of said pairs forming a unit of voltage from any one of said common terminals, means for supplying, if said detecting means detects said occurrence while any one of said EL elements is being fed with one said unit of voltage, said one EL element with said one unit of voltage so that said first and second voltages of said one unit of voltage are applied to said one EL element, and means for stopping the supply of said first and second voltages to said EL elements through said common electrodes whereby after said detection of said occurrence only one of said units of voltage is supplied to said one EL element.

11. An apparatus according to claim 10, wherein said executing means includes means for stopping driving of said EL elements through said channel electrodes.

12. An apparatus according to claim 10, wherein said image bearing body is developed in a developing operation after the light emitting operation is executed thereon whereby an image is developed on said image bearing body and transferred therefrom to an image forming medium which is subject to jamming, and wherein said detecting means for detecting the jamming of said image forming medium.

* * * * *